United States Patent [19]

Martin

[11] 4,176,634

[45] Dec. 4, 1979

[54] FUEL INJECTION SYSTEM

[75] Inventor: Barrie J. Martin, Shenfield, England

[73] Assignee: Plessey Handel und Investments AG, Zug, Switzerland

[21] Appl. No.: 815,309

[22] Filed: Jul. 13, 1977

[30] Foreign Application Priority Data

Jul. 14, 1976 [GB] United Kingdom ..... 29202/76

[51] Int. Cl.[2] ..... F02M 27/08; F02M 7/00

[52] U.S. Cl. ..... 123/119 EE; 123/119 R; 123/119 E; 123/141; 261/DIG. 48; 261/78 A; 261/81

[58] Field of Search ..... 123/119 EE, 119 E, 141 R, 123/119 R; 261/DIG. 48, 81, 78

[56] References Cited

U.S. PATENT DOCUMENTS

| | | | |
|---|---|---|---|
| 862,856 | 8/1907 | Tygard | 123/141 |
| 2,414,494 | 1/1947 | Vang | 123/119 EE |
| 2,454,900 | 11/1948 | Vang | 123/119 E |
| 2,532,554 | 12/1950 | Joeck | 123/119 E |
| 2,791,994 | 5/1957 | Grieb | 123/119 EE |
| 2,908,443 | 10/1959 | Fruengel | 123/119 EE |
| 2,949,900 | 8/1960 | Bodine | 123/119 EE |
| 3,857,543 | 12/1974 | McKeen | 123/119 EE |
| 3,977,383 | 8/1976 | Nagumo | 123/141 |

FOREIGN PATENT DOCUMENTS

| | | | |
|---|---|---|---|
| 2009253 | 9/1971 | Fed. Rep. of Germany | 123/119 E |
| 2142246 | 3/1973 | Fed. Rep. of Germany | 123/141 |
| 982461 | 2/1965 | United Kingdom | 123/141 |
| 1406111 | 9/1975 | United Kingdom | 123/119 EE |

*Primary Examiner*—Wendell E. Burns
*Attorney, Agent, or Firm*—Fleit & Jacobson

[57] ABSTRACT

A fuel injection system comprising a vibrating fuel injector and a vibrating butterfly or sliding valve so positioned that it receives fuel from the injector and further vibrates it to further break it up.

7 Claims, 3 Drawing Figures

FUEL INJECTION SYSTEM

This invention relates to a fuel injection system.

Accordingly, this invention provides a fuel injection system comprising fuel injection means for injecting fuel into an air stream for an engine, and valve means for controlling the air stream, the fuel injection means being so positioned that it injects fuel towards the valve means, and the valve means being capable of being vibrated so that insufficiently atomized fuel from the fuel injection means is further atomized by its contact with the vibrating valve means.

The valve means may be capable of linear and/or pivotal movement. The valve means may thus move to vary the opening size of an air duct or a sleeve positioned in the air duct. The position of the valve means, for example in an air duct leading to the engine, may be variable in a known manner, for example by means of foot pressure applied to a throttle pedal in a motor vehicle. Advantageously, the valve means is spring biassed back to its original position.

If desired, the valve means can be fixed in position so that it only vibrates and does not pivot or move linearly apart from when it is being vibrated. In this case, a movable sleeve is advantageously moved towards and away from the valve means to vary the size of the opening through the sleeve.

The valve means may be a substantially flat valve element, for example a disc, having attached thereto a vibratory nozzle, the nozzle having a piezoelectric device attached at its end romote from the valve element. It is presently preferred that the vibration of the valve means be effected by piezoelectric devices, such for example piezoelectric ceramic or crystal devices, but it is to be appreciated that other vibratory transducer means may be employed such for example as magnetostrictive devices or electromagnetic devices. Usually, the vibrations of the butterfly valve will be effected at substantially ultrasonic frequency to avoid production of excessive noise which may sometimes occur at lower frequencies.

The valve means may also be a substantially flat valve element, for example a disc, having a piezoelectric device extending substantially over its area. If desired, the piezoelectric ceramic device may be sandwiched between two plates, for example two metal plates.

Preferably, the fuel injection means is an injection nozzle adapted to be vibrated when the fuel is to be injected. The injection nozzle may have a fuel shut-off valve, element e.g. a ball valve, which normally closes an injection orifice for the injection nozzle and which is moved off its seat during periods when the injection nozzle is being vibrated thereby to allow the fuel to be injected through the injection nozzle orifice.

The fuel injection means may face the valve means so that it is adapted to spray fuel towards the valve means at substantially a right angle. Alternatively, the injection means may be so positioned with respect to the valve means that it sprays fuel at an angle. When the injection means is spraying fuel at an angle, the valve means can advantageously be of the pivotal type.

The injection means can be situated upstream or downstream of the valve means. When the injection means is situated downstream of the valve means, it will be apparent that the valve means is effective to control only air. When the injection means is situated upstream of the valve means, it will be apparent that the valve means is then effective to control not only the air but also the fuel that is admixed with the air.

Embodiments of the invention will now be described solely by way of example and with reference to the accompanying drawings in which.

Figure 1:
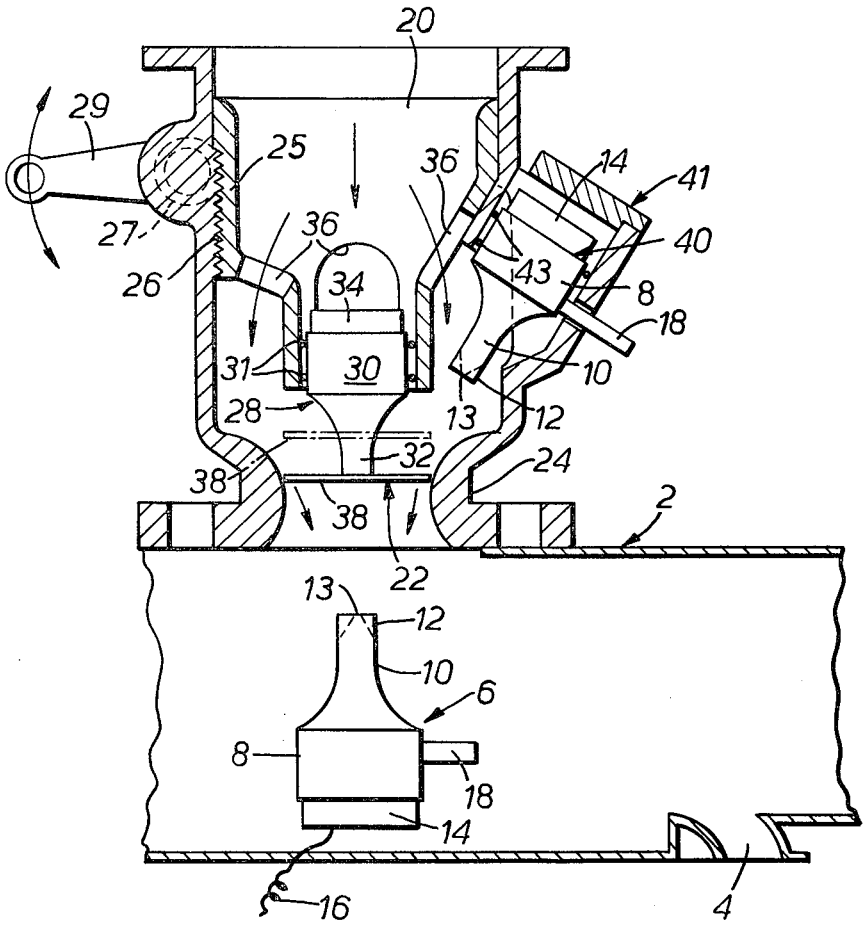
FIG. 1 shows a first fuel injection system in accordance with the invention.

Referring to FIG. 1, there is shown an inlet manifold 2 having four inlet pipes 4 (only one of which is shown) leading to an internal combustion engine (not shown). Provided in the manifold 2 is a fuel injection means 6. The fuel injection means 6 comprises a body portion 8 having extending therefrom a nozzle portion 10. As shown, the fuel injection means 6 is positioned wholly in the manifold 2 but, if desired, only the end 12 of the nozzle portion 10 need be positioned in the manifold. The end 12 of the nozzle portion 10 is provided with a nozzle orifice 13 and this orifice 13 is adapted to be closed by a ball valve (not shown) during periods when the fuel injection means 6 is not being vibrated. The fuel injection means 6 is vibrated by means of a piezoelectric device 14 which is attached to the body portion 8 as shown and which is excited by means of an electric current passing along lead 16.

When the piezoelectric device 14 is excited, it causes the fuel injection means 6 to vibrate. The ball valve is knocked off its seat by the vibrations and fuel fed to the fuel injection means 6 by means of a pipe 18 is injected through the nozzle orifice as a fine spray. This fine spray of fuel mixes with the air in the manifold 2.

The air enters the manifold 2 by passing along an air inlet duct or carburettor 20. the flow of air in the duct 20 is controlled by means of a butterfly valve element 22 operated in a neck portion 24 of the duct 20. The butterfly valve element 22 is adapted to move linearly, i.e. to slide into and out of the neck 24, by virtue of the fact that it is attached to a housing 25 which is provided with teeth 26. The teeth 26 mate with a gear wheel 27 which is rotated by a crank arm 29 in response, for example, to engine throttle pedal movement. When the butterfly valve element 22 is positioned squarely in the neck 24 as shown, it will be apparent that only a minimum amount of air can proceed along the duct 20, between the valve element 22 and the neck portion 24 into the duct 2. As the valve element 22 is moved away from the neck portion 24, more air can flow past the valve element 22 and into the duct 2 for admixture with the fuel from the injector nozzle 6. The air passes through the housing 25 by means of ports 36.

A vibrator device 28 is attached to the valve element 22 for vibrating the valve. The vibrator device is mounted in the housing 25 by means of O-ring seals 31. For convenience, the vibrator device 28 is constructed similarly as the fuel injection means 6 and thus has a body part 30, a nozzle part 32 and a piezoelectric device 34 excited by means of an electric current. Excitation of the piezoelectric device 34 causes the device 28 and therefore the attached valve element 22 to vibrate.

As the fuel is sprayed or injected from the fuel injection means 6, much of it will be carried away by the air in the manifold 2 to the engine via the inlet pipes 4. Any particles of insufficiently atomized fuel that are present will strike the surface 38 of the valve element 22 and the vibrations imparted to this surface 38 will be effective to toss the fuel back into the manifold 2 whilst also breaking the fuel up. Thus good fuel atomization and therefore fuel economy will be achieved.

In an alternative arrangement, the injection nozzle could be situated as shown at 40 in FIG. 1. In this case, the valve element 22 and its attached vibrating device will usually be pivotable. The injection nozzle 40 is constructed and operates substantially the same as the injection nozzle 6 and similar parts have therefore been given the same reference numeral and will not again be described. The injection nozzle 40 is mounted in a housing part 41 and O-ring seals 43 are employed for mounting purposes.

It will be appreciated that when the fuel is injected from the fuel injection means 40, the valve element 22 is effective to control the air and also the fuel passing through the neck portion 24 to the engine. In contrast, when the fuel is injected from the fuel injection means 6, the valve element 22 only controls the air passing through the neck 24 and this controlled air is then mixed with the fuel.

Figure 2:
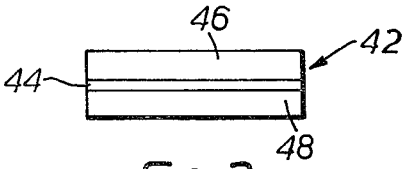
FIG. 2 shows a modification of part of the fuel injection system shown in FIG. 1.

Referring now to FIG. 2, there is shown an alternative arrangement for the valve element 22 and the vibrating device 28. In FIG. 2, the valve element 42 is formed with an integral vibrating device in the form of a piezoelectric ceramic or crystal device 44. This device 44 is sandwiched between two metal plates 46, 48. It will be apparent that the arrangement shown in FIG. 2 is more compact than the arrangement 22, 28 shown in FIG. 1. Thus the device shown in FIG. 2 may be easier to install, especially where pivoting applications of the valve element are required.

Figure 3:
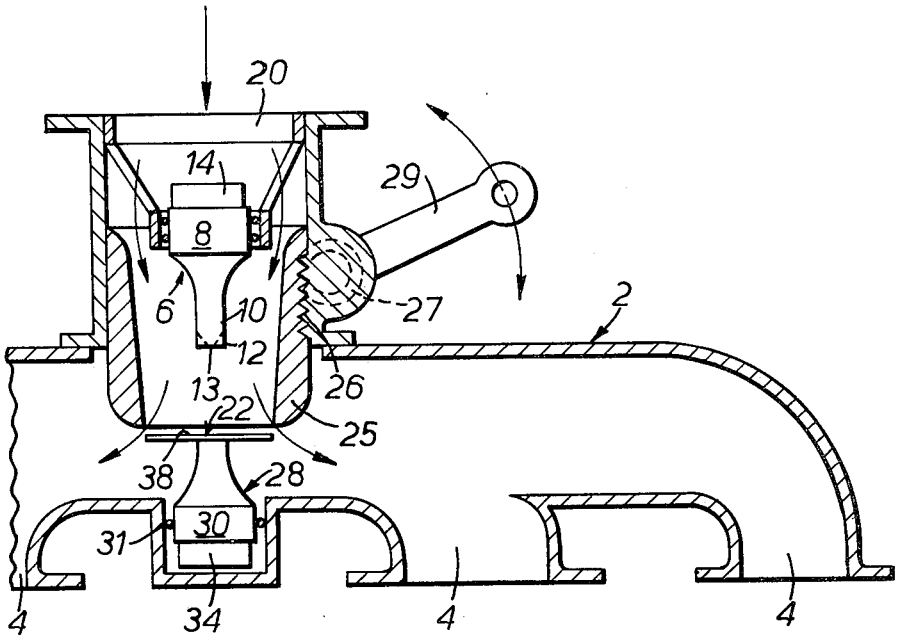
FIG. 3 shows a second fuel injection system in accordance with the invention.

In FIG. 3, similar parts as in FIG. 1 have been given the same reference numeral. By comparing FIGS. 1 and 3, it will be seen that the position of the fuel injection means 6 and the vibrator device 28 have been reversed in FIG. 3 from the position shown in FIG. 1. In FIG. 3, the vibrator device 28 and the fuel injection means 6 are both only mounted for vibration. The housing 25 is formed as a sleeve which is movable towards and away from the valve element 22 by the crank arm 29 to control the amount of fuel and air passing through the centre of the sleeve 25 and between the annular orifice formed between the end of the sleeve 25 and the valve element 22. Since the vibrator device 28 and the fuel injection means 6 are fixed in position, it is relatively easy to determine and maintain a distance apart for the device 28 and the injection means 6 which gives a good fuel spray angle from the injection means 6 and the desired amount of fuel impingement on the surface 38 of the valve element 22.

It is to be appreciated that the embodiments of the invention described above have been given by way of example only and that modifications may be effected. Thus, magnetostrictive vibrating means may be employed instead of the piezoelectric devices 14, 34. Also, other constructions for the valve, element 22 and the fuel injection nozzle 6 may be employed.

What we claim is:

1. Apparatus for injecting atomized fuel into an air stream for an engine, said apparatus comprising:

first vibrating means;

valve means including a valve element for controlling said air stream, said valve element being responsive to said first vibrating means for atomizing fuel injected toward said valve element;

second vibrating means; and fuel injection means, responsive to said second vibrating means, for atomizing and injecting fuel into said air stream and toward said valve element, wherein said valve element further atomizes any of the fuel not previously atomized by said fuel injection means.

2. A fuel injection system according to claim 1, in which the valve means is fixed in position, the fuel injection system then comprising a movable sleeve which is adapted to be moved towards and away from the valve means to vary the size of the opening through the sleeve.

3. A fuel injection system according to claim 1 in which the valve means is a substantially flat valve element having attached thereto a vibratory nozzle, the nozzle having a piezoelectric device attached to its end remote from the valve element.

4. A fuel injection system according to claim 1, in which the fuel injection means includes an injection nozzle adapted to be vibrated when the fuel is to be injected.

5. A fuel injection system according to claim 4, in which the injection nozzle has a fuel shut-off ball valve element which normally closes an injection orifice for the injection nozzle and which is moved off its seat during periods when the injection nozzle is being vibrated thereby to allow the fuel to be injected through the injection nozzle orifice.

6. A fuel injection system according to claim 1 in which the fuel injection means faces the valve means so that it is adapted to spray fuel towards the valve element at substantially a right angle.

7. A fuel injection system according to claim 1 in which the valve means is so positioned that it controls the air stream after the air stream has had fuel mixed with it.

* * * * *